US008210660B2

(12) United States Patent
Anderson et al.

(10) Patent No.: US 8,210,660 B2
(45) Date of Patent: Jul. 3, 2012

(54) HIGH VOLUME INK DELIVERY MANIFOLD FOR A PAGE WIDE PRINTHEAD

(75) Inventors: Frank Edward Anderson, Sadieville, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 421 days.

(21) Appl. No.: 12/624,078

(22) Filed: Nov. 23, 2009

(65) Prior Publication Data

US 2011/0122194 A1 May 26, 2011

(51) Int. Cl.
*B41J 2/045* (2006.01)

(52) U.S. Cl. ..... 347/71; 347/85

(58) Field of Classification Search ..... 347/40, 347/42, 44, 56, 61, 67–72, 84–86
See application file for complete search history.

(56) References Cited

U.S. PATENT DOCUMENTS 8,061,821 B2 * 11/2011 Irie ..... 347/71
2008/0204522 A1 * 8/2008 Kajiura et al. ..... 347/72

* cited by examiner

*Primary Examiner* — Thinh Nguyen

(57) ABSTRACT

An ink manifold for supplying liquid ink to a heater chip of an inkjet printhead. Ink ports on one side of the manifold feed liquid ink to the ink channels on the other side of the manifold, and thus to the backside ink trenches of the heater chip. The placement and number of ink ports formed in the ink manifold are optimized so that when the heater chip and the ink manifold are scaled down in size, the ink carrying capacity of the printhead components is not compromised. Similarly, when the ink manifold is scaled down, the optimization process allows the seal width between the ink port features of the manifold to be maintained above a specified minimum.

20 Claims, 6 Drawing Sheets

| | | | | |
|---|---|---|---|---|
| X | Y | | | |
| X | | | | |
| X | | | | |
| X | | | | |
| X | | | | |

n = 5
k = 1

Fig. 10

| | | | | |
|---|---|---|---|---|
| X | | Y | | |
| | X | | | |
| X | | | | |
| | X | | | |
| X | | | | |

n = 5
k = 2

Fig. 11

| | | | | |
|---|---|---|---|---|
| X | | Y | | |
| | X | | | |
| X | | | | |
| | X | | | |
| X | | | | |
| | X | | | |

n = 6
k = 2

Fig. 12

| | | | | |
|---|---|---|---|---|
| X | | | | Y |
| | X | | | |
| | | X | | |
| | | | X | |

n = 4
k = 5

Fig. 13

| | | | | |
|---|---|---|---|---|
| X | | Y | | |
| | X | | | |
| | | X | | |
| X------X | | | | |

n = 4
k = 3

Fig. 14

| | | | | |
|---|---|---|---|---|
| X | | Y | | |
| | X | | | |
| | | X | | |
| X------X | | | | |
| | X------X | | | |

n = 5
k = 3

Fig. 15

| | | | | |
|---|---|---|---|---|
| X | | | Y | |
| | X | | | |
| | | X | | |
| | | | X | |
| X------X | | | | |
| | X------X | | | |

n = 6
k = 4

Fig. 16

| | | | | |
|---|---|---|---|---|
| X | | | Y | |
| | X | | | |
| | | X | | |
| | | | X | |
| X------X | | | | |
| | X------X | | | |
| | | X------X | | |

n = 7
k = 4

Fig. 17

| | | | | |
|---|---|---|---|---|
| X | | | Y | |
| | X | | | |
| | | X | | |
| | | | X | |
| X | | | | |
| | X | | | |
| | | X | | |
| | | | X | |

n = 8
k = 4

Fig. 18

| | | | | |
|---|---|---|---|---|
| X | | | Y | |
| | X | | | |
| | | X | | |
| | | | X | |
| X | | | | |
| | X | | | |
| | | X | | |
| | | | X | |
| X | | | | |

n = 9
k = 4

Fig. 19

HIGH VOLUME INK DELIVERY MANIFOLD FOR A PAGE WIDE PRINTHEAD

BACKGROUND

1. Field of the Invention

The present invention relates generally to inkjet printheads, and more particularly to methods for designing ink delivery manifolds employed with page wide printheads.

2. Description of the Related Art

Printers, copiers and other related reproduction equipment often employ printheads to deposit ink onto a print medium to provide readable characters and images. A programmed controller is often utilized to rasterize the print data and couple the same to the printhead to cause droplets of ink to be deposited on the print medium in the form of characters, such as letters, symbols, images, etc. Printheads are typically constructed with a number of miniature nozzles that are electrically addressable to cause ink to be jetted from desired nozzles to form the characters on the print medium. In practice, a printhead includes a heater chip with plural chambers where the ink can be nucleated into a drop and ejected therefrom, a nozzle plate attached to the heater chip to form the droplet of ink, an ink manifold to route the ink to the heater chip, and an ink supply of some type, whether it be a cartridge or ink tank.

Reproduction equipment utilizing inkjet printheads often use a single printhead that is moved back and forth in a swath laterally across the print medium to deposit ink dots in desired positions along a line. Once each line of ink dots is printed, the print medium is incrementally advanced to print another sequence of ink dots. As a number of lines of ink dots are incrementally printed on the medium, a string of letters or other characters is formed. Each additional string of characters is formed in the same manner, namely alternately moving the printhead in a swath across the print medium and incrementally advancing the paper.

Another technique for printing characters is to employ a page wide printhead which extends laterally across the width of the print medium. With this technique, the page wide printhead does not move, but rather prints a single line of ink dots substantially simultaneously. Then, the print medium is advanced so that a subsequent line of ink dots can be printed. As can be appreciated, the use of the page wide printhead significantly reduces the time required to print a string or page of characters, as the printhead does not have to be scanned across the width of the print medium.

While the utilization of a page wide printhead is an efficient method for quickly printing many characters, the construction of such type of printheads is more complicated and thus more costly and prone to manufacturing errors. Many of the components of a printhead, especially the heater chip and the manifold, are constructed using semiconductor wafers and corresponding processing techniques. As such, the fabrication of a page wide printhead for standard letter-size paper, requires a printhead having a lateral length of about eight and one-half inches. In this instance, the conventional practice is to use a number of individual heater chips that are mounted on a support that spans the width of the print medium. The heater chips are staggered or offset so that a standard space exists between the last nozzle of one heater chip and the first nozzle of the adjacent heater chip. The spacing between each printable ink dot in a line is thus the same, even between adjacent (and staggered) heater chips. Liquid ink is applied to a long and narrow ink via on the top side of the heater chip, where the ink is supplied internally in the heater chip to the many heater chambers. Each heater chamber includes a heater (often a resistor) for each nozzle that is addressable by the print controller to heat the ink in the respective chamber and nucleate the same so that it is jetted downwardly through the nozzle plate onto the print medium.

In addition to heater chips, a manifold is required in order to couple the liquid ink from a reservoir to the backside ink trenches and thus to the various heater chambers of each heater chip. When printing characters in color, the heater chip employs a row of heater chambers and an ink via for each color. The manifold construction is correspondingly more complicated when printing characters in color. If, for example, magenta, yellow, cyan and black ink colors are utilized for the primary colors to print an image of any color, then the manifold must have at least four different ink channels to accommodate the four different colors of ink. Moreover, the different ink channels must be extended to the various backside ink trenches of the individual heater chips. It can thus be appreciated that the construction of the ink manifold is complicated, in that very small channels must be formed in circuitous paths in the manifold to couple the liquid ink to the individual heater chamber structures of the heater chips. Owing to the fact that the individual heater chips can each have hundreds of heater chambers and corresponding nozzles, the ink delivery manifold can be challenging to manufacture.

Because of its complexity, a manifold for routing liquid ink from a source to the backside ink trenches of the heater chip is often constructed of a semiconductor material which can be processed with micron-size features. The manifold typically includes ink ports on the top surface to mate to the ink supply, and elongate ink channels of the bottom surface to mate with the backside ink trenches of the underlying heater chip. For purposes of efficiency, the manifold can be made in a top half and a bottom half, with each half etched to form the desired features, such as ink ports in the top half and the ink channels in the bottom half. At least one manifold half is formed so that the desired ink ports are in liquid communication with the desired ink channels. The manifold halves can then be bonded together so that when liquid ink of a certain color is applied to a top ink port, it is routed internally in the manifold to a specified ink channel on the bottom. Accordingly, the different colors of ink are efficiently supplied to the specified ink channels and thus to the corresponding backside ink trenches of the heater chip. However, even when manufacturing manifolds for page wide printheads, the semiconductor material of the manifold can be as long as the print medium is wide. In other words, the semiconductor manifold can be made eight and one-half inches long for printing on a letter-size page.

The design trend is to make the semiconductor heater chips, which together comprise a major part of the printhead, smaller in size without compromising performance. The price of a heater chip generally corresponds to the size of the semiconductor material from which it is made, as the smaller the semiconductor chip, the more chips can be made from a wafer of a give size. Similarly, as the size of the heater chip is reduced, the features are also reduced in size. One feature of a heater chip that is sensitive to size are backside ink trenches which channel the liquid ink to the heater chambers of the heater chip. In other words, if the sizes of the backside ink trenches in the heater chips are simply scaled down the ability to maintain the volume flow rate of ink to the heater and nozzle structures is reduced. With a smaller cross-sectional size of an ink channel, the volume flow rate of ink can be restricted and the efficiency of the printhead will be compromised.

The design of ink manifold, and especially the surface thereof that mates to the heater chip, must have the same shape and size features as that of the heater chip to which it is mated. When features of the heater chip are made smaller, then the ink delivery features on the bottom surface of the ink manifold that mates with the heater chip should also be made of comparable size and location so that when the two are mated together, the volume flow rate of ink is not restricted between the two printhead components. As noted above, the ink manifold has ink delivery channels on the bottom side thereof which mate with the backside ink trenches on the top of the heater chip. The manifold also has ink ports on the top side for mating with a base member, or other structure in liquid communication with the ink supply. The placement and size of the ink ports formed in the manifold is also of concern when scaling the size of the components, as the ink port design can be optimized to allow a sufficient amount of ink to be delivered without choking the supply of ink.

As the size of the semiconductor components of a printhead are scaled down, the spacing of the features thereof is also made smaller. For example, not only are some of the features, such as the ink ports and channels made smaller, but the distance between each port and between each channel is made smaller. There is a practical limit in making the features closer together, as the bonding agent that adheres the manifold to the heater chip requires a certain minimum surface area to be spread or dispensed thereon, so that the bonding agent does not run into the port or channel structures. When the manifold and heater chip are bonded together with an adhesive, the process is usually carried out using robotic devices which apply the adhesive through a syringe-type device around the various features, and then the pieces are placed together until the adhesive has set and cured. As can be appreciated, the accuracy by which the robotic mechanism can apply a specified amount of adhesive has practical limits, and thus the fabrication of the manifold and the heater chip must accommodate the inaccuracies inherent in the adhesive-applying process. Often, an entire wafer of manifold structures is bonded to a wafer of heater chips, and then the components are cut from the composite wafer as individual units.

From the foregoing, it can thus be seen that a need exists for a technique to make a semiconductor manifold for an ink jet printhead that is cost effective and with optimized features for ink delivery. Another need exists for a technique for fabricating an ink delivery manifold having many ink ports for each ink channel to thereby allow a large volume of ink to be carried therethrough. Another need exists to better utilize the area of a semiconductor wafer, and facilitate assembly of the printhead components.

SUMMARY OF THE INVENTION

According to one embodiment of the invention, a page wide printhead includes plural offset heater chips for nucleating liquid ink to form droplets of ink jetted onto a print medium. Each heater chip is attached to an ink manifold that supplies ink of various colors to the associated heater chip. The features of the heater chip are scaled down in size to reduce the cost thereof. In like manner, the ink manifold is also scaled down in size so as to be attached to a scaled heater chip. In order to assure that the ink manifold can supply a given volume of ink per unit of time, and maintain a given distance, or seal breadth between the ink manifold features, the ink manifold is fabricated to assure these parameters are met.

According to a feature of the invention, the ink manifold is constructed with one ink channel per ink color on one side thereof, and with plural ink ports on the other side thereof, where ones of the ink ports on the one side are in liquid communication with respective ink channels on the other side. The length of the ink channels are divided into sections, where each section is of the same length. There is one ink port located in each channel section at specific locations to assure that the ink carrying capacity to each ink channel is satisfied, and that the seal breadth between neighbor ink ports is also satisfied.

According to another feature of the invention, the length of the channel sections is minimized to allow more channel sections to be realized, and thus more ink ports per associated ink channel, and thus maximize the ink carrying capacity to the ink channels.

According to yet another feature of the invention, the channel sections are arranged in a grid of rows and columns, and the ink ports located in various channel sections are aligned on a diagonal with neighbor ink ports serving other channels.

In accordance with an embodiment according to the invention, disclosed is an ink manifold for use with a heater chip in an inkjet printhead, where the ink manifold includes a first planar surface and a second opposite planar surface. A plurality of ink channels are located on the first planar surface of said ink manifold. The ink channels supply ink to the heater chip, and each ink channel is divided into plural sections where each section is the same length. A plurality of ink ports are located on the second opposite planar surface of the ink manifold, and the ink ports are in liquid communication with respective ink channels in the manifold. A single ink port is located in each section of each ink channel.

In accordance with another embodiment of the invention, disclosed is a method of fabricating an ink manifold for use with a heater chip in an inkjet printhead. The method includes forming plural parallel-located ink channel in one surface of the ink manifold so as to be in liquid communication with respective backside ink trenches of the heater chip when the ink manifold is bonded to the heater chip. Plural ink port are formed in an opposite surface of the ink manifold, and the ink ports are formed so as to be in liquid communication with respective ink channels in the ink manifold. Each ink port has a shape in the surface of the ink manifold defined by a boundary. The ink ports are arranged in the ink manifold so that a plurality of ink ports communicate liquid ink to each ink channel. The ink ports are arranged in the ink manifold so that a specified minimum seal width exists between the boundaries on neighbor ports.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIGS. 10-19 illustrate various port configurations for an ink manifold, where the locations thereof are optimized for ease of fabrication and functionality.

DETAILED DESCRIPTION

Figure 1:
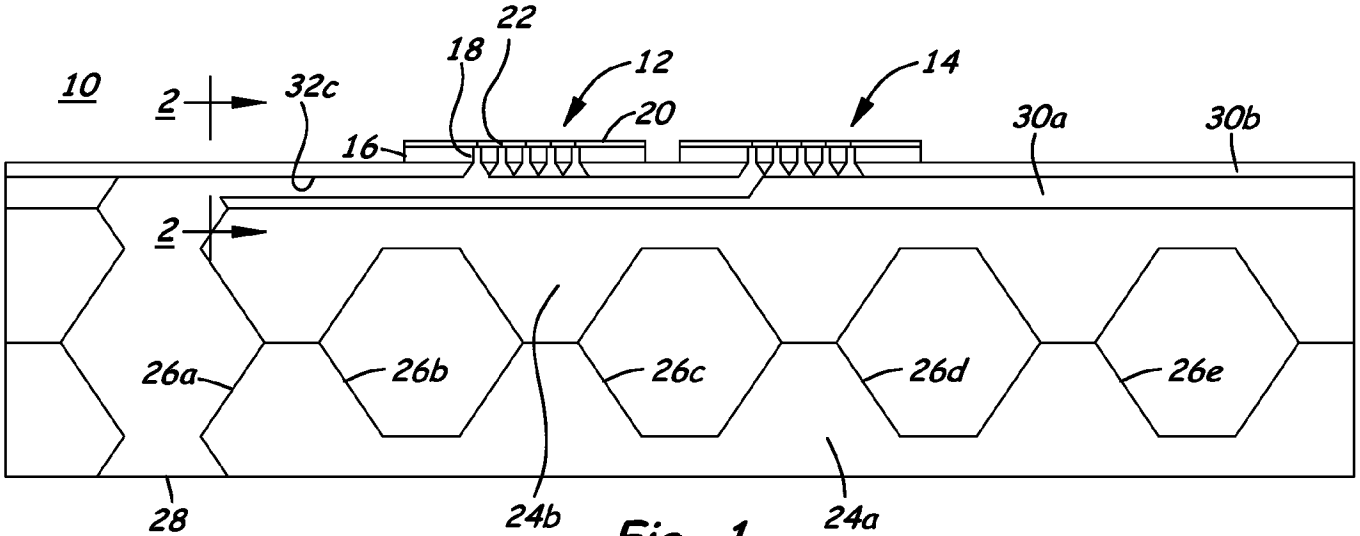
Fig. 1 (PRIOR ART)
FIG. 1 is a cross-sectional view of an inkjet printhead assembly and a pair of offset heater chips for a page wide print mechanism known in the prior art.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant herein to encompass the items listed thereafter and equivalents thereof as well as additional items. Unless otherwise limited, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

FIG. 1 illustrates a page wide printhead 10 constructed according to techniques known in the prior art. The printhead 10 is adapted for coupling a plurality of colors of liquid ink to respective nozzles of the individual heater chips, two of which are shown as numerals 12 and 14. While only two heater chips 12 and 14 are illustrated, in practice there are many other similarly offset heater chips coupled to the printhead 10 to provide a page wide print mechanism. The print medium passes adjacent the heater chips 12 and 14 in the direction either left or right on the drawing of FIG. 1. While the illustrated ink jet printhead can be oriented in various positions, the printhead is generally inverted from that shown in FIG. 1, so that the jets of the individual heater chips are oriented downwardly as the print medium passes left or right under the ink jet heater chips 12 and 14.

The heater chip 12 is constructed according to known techniques using a semiconductor material to form the circuits therein for firing droplets of ink from the nozzles, one shown as numeral 18. A typical heater chip 12 is constructed with many nozzles 18. Many times, several hundred nozzles 18 per color are formed in a very small area to provide a large number of dots per unit of paper length. The size of the semiconductor heater chip 12 can be anywhere from about 6 mm to 25 mm in length and about 2 mm to 10 mm in width. The heater chip 12 can range from about 300 micron to 800 micron in thickness. However, these dimensions are not a limit on the practice of the invention. As noted above, for page wide applications, the plurality of heater chips and associated ink manifolds are alternately offset from each other on a unitary base member which spans the width of the print medium being printed.

Attached to the top of the heater chips 12 is a nozzle plate 20 having formed therein the miniature nozzle openings 22 that function to jet the droplets of ink therefrom when nucleated by the respective heater chambers in the semiconductor heater chip 12. In the embodiment illustrated, the heater chip 12 is constructed with many rows and columns of nozzles 18, one column shown with a respective nozzle for each of the five rows, it being understood that there are many nozzles in each row. Each row of nozzles is adapted to print a respective color, such as cyan, magenta, yellow, and two nozzle rows that print black ink. Other colors of inks and other liquids can be printed, such as a precoat liquid that prevents the subsequently deposited ink dots from soaking into the print medium. The page wide printhead mechanism can also be adapted for printing monochrome characters, if desired.

Because of the utilization of numerous different inks and liquids during the printing process, the ink channels are required to not only be separated from the other channels, but take circuitous paths in the printhead 10 to feed ink to each of the associated nozzles of the individual heater chips. It can be appreciated that when hundreds of nozzles are involved for each heater chip, and with multiple heater chips, as well as multiple colors of ink, the reliable routing or coupling of ink to the respective nozzles of all of the printheads can be extremely complicated.

Figure 2:
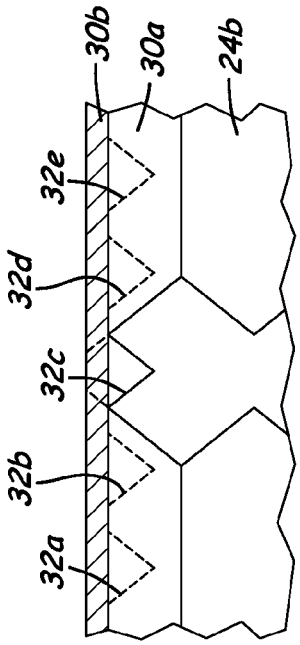
FIG. 2 is a cross-sectional view of the inkjet printhead assembly of FIG. 1, taken along line 2-2 thereof.

The printhead 10 functions to provide various colors of ink from respective ink reservoirs or supplies, to the individual ink channels and thus to the multiple heater chips of the printhead. In FIGS. 1 and 2, the printhead 10 is shown with a two-piece silicon ink supply structure 24*a* and 24*b*. Elongate ink supply conduits 26 are partially formed in each ink supply structure 24*a* and 24*b*, so that when attached together, a hexagonal-shaped conduit is formed. The ink supply structures 24*a* and 24*b* can be bonded together by various techniques, including direct room temperature bonding, fusion bonding, eutectic, anodic, adhesive and other suitable techniques. In the illustrated embodiment, there is a separate ink supply conduit 26 for each color of ink. Since there are five rows of nozzles in the printheads in the example, each adapted for printing with a different color ink, there is a corresponding ink supply conduit 26*a*-26*e* for each color. The ink supply conduits 2*a*-26*e* are adapted for carrying ink in a direction which would be into the drawing. The ink supply conduit 26*a* receives ink from an inlet 28 which is coupled to a reservoir of liquid ink. The other four ink supply conduits 26*b*-26*e* are similarly connected with respective inlets (not shown) to separate reservoirs of liquid ink. As noted above, in the illustrated embodiment, two rows of nozzles in the printheads utilize the same black ink, and thus such rows of nozzles are coupled through the printhead 10 via conduit 26*e* to the same reservoir of black ink.

While not shown, the silicon ink supply structure 24*a* and 24*b* is supported on a base member (not shown) which is often constructed of a durable and rigid plastic or ceramic material that spans the width of the print medium. The base member includes holes therein for coupling the inlets 28 of each of the five ink supply conduits 26*a*-26*e* to the respective ink reservoirs. In practice, the base member is coupled to the respective ink reservoirs by flexible tubes, or the like.

Attached to the top of the ink supply structure 24*a* and 24*b* is a two-part silicon ink channel structure 30*a* and 30*b*. The two-part ink channel structure 30*a* and 30*b* can be bonded together in the same manner as the two-part ink supply conduit structure 24*a* and 24*b*. The ink channel structure 30*a* and

30*b* is constructed with plural channels 32*a*-32*e* (FIG. 2). The ink channel, for example channel 32*c*, couples ink from a respective ink supply conduit 26*a* to the associated backside ink trench of a row of nozzles in both printheads 12 and 14. Other similar ink channels are connected between the ink supply conduit 26*a* to the same row of nozzles in the other heater chips (not shown) of the page wide printhead mechanism. As shown in FIG. 2, there are four other ink channels 32*a*, 32*b*, 32*d* and 32*e* that carry other colors of ink from the other ink supply conduits 26*b*-26*e* to the other rows of nozzles in the heater chips. According to the prior art techniques, each ink channel structure 30*a* and 3*b* is constructed from a single piece of silicon, and is about the same length (as measured into the drawing) as the print medium being printed. When the print mechanism is adapted for printing conventional letter-size paper, then the silicon wafers from which the ink channel structures are constructed are required to be no less than about eight and one-half inches in diameter.

Figure 3:
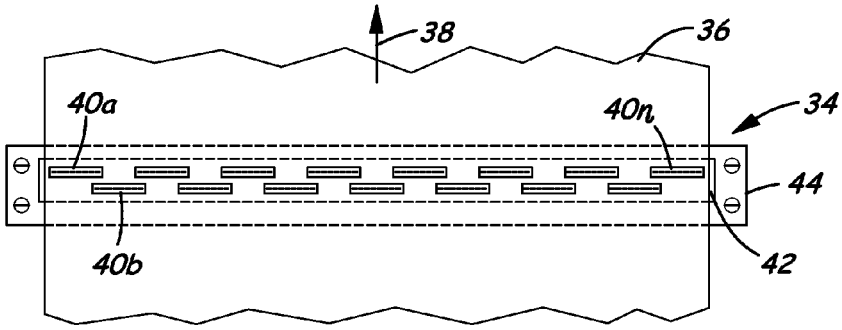
FIG. 3 is a bottom view of a page wide printhead that spans the width of the print medium.

FIG. 3 illustrates a bottom view of a page wide inkjet printhead 34 for printing characters on a print medium, such as a sheet of paper 36. The printhead 34 spans the width of the sheet of paper 36 and prints the characters thereon by way of many ink droplets, as the paper 36 is moved by a carriage apparatus (not shown) in the direction of arrow 38. The heater chips 40*a*, 40*b* . . . 40*n* are situated on respective ink manifolds 42 which are bonded to the base member so that neighbor heater chips are offset from each other, as shown. With this arrangement of heater chips 40, the nozzles of each heater chip are spaced a predefined standard distance from each other, and the last nozzle of one heater chip is spaced from the first nozzle of the neighbor heater chip the same standard distance. As such, the offset nature of the heater chips 40 does not present a discontinuity between the dots of a line of ink dots printed on the medium 36. Each of the semiconductor manifolds is attached to a ceramic base member 42 which can be fastened to the printer chassis 44, or the like, so that the print medium 36 can pass thereunder in close proximity to the heater chips 40.

Figure 4:
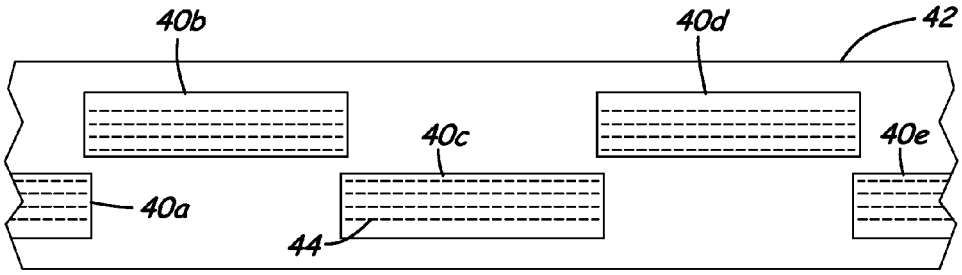
FIG. 4 is a plan view of a portion of a page wide printhead, showing the individual heater chips (and respective ink manifolds thereunder) as attached to the long base member.

FIG. 4 is an enlarged view of a portion of the printhead of FIG. 3. The heater chips, such as heater chip 40*c*, includes plural rows and columns of nozzles, one row shown as numeral 44. The heater chips 40 need not be specially constructed for use with the ink manifold of the invention. Rather, the principles and concepts of the ink delivery manifold can be employed with conventionally available ink jet heater chips.

Figure 5:
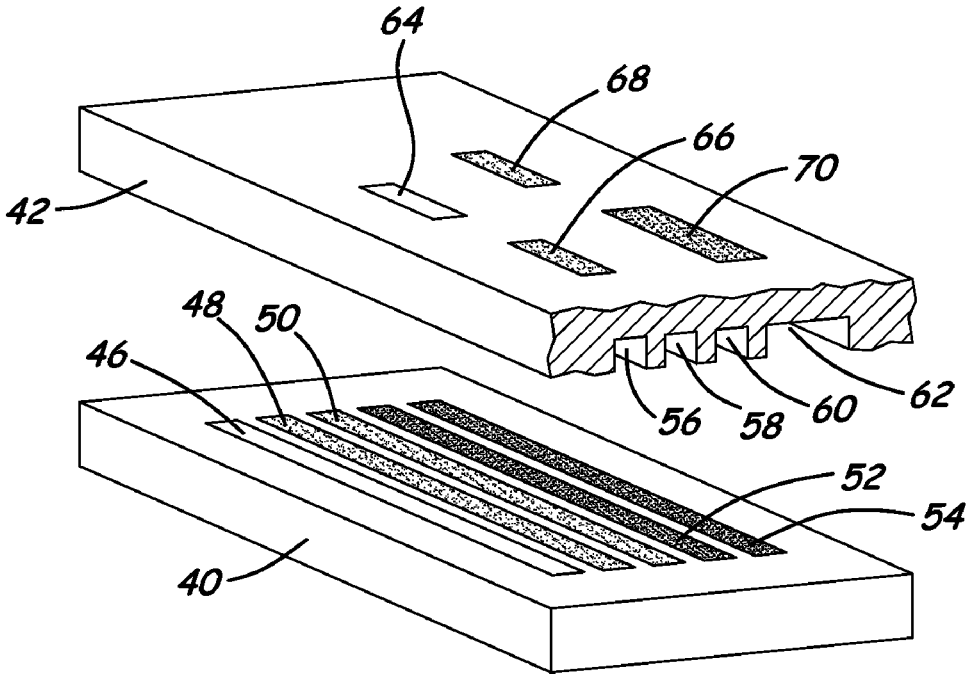
Fig. 5 (PRIOR ART)
FIG. 5 is a top view of an individual heater chip illustrating the backside ink trenches, and a cross-sectional view of the overlying ink manifold with the ink ports on top and the ink channels on the bottom thereof.

FIG. 5 illustrates the top surface of a portion of a conventional heater chip 40, with an arrangement of backside ink trenches, one shown as numeral 46. The backside ink trench 46 receives a supply of ink and couples the ink internally to the individual heater chambers where the ink is nucleated to form a droplet of ink that is jetted from a nozzle plate (not shown), which is situated on the bottom side of the heater chip 40. The backside ink trench 46 can be supplied with an ink having a magenta color. In like manner, the backside ink trench 48 can be supplied with a cyan colored ink, and the backside ink trench 50 can be supplied with a yellow colored ink. Lastly, in the example, the two backside ink trenches 52 and 54 can both be supplied with a black colored ink. The rows and columns of nozzles are located on the bottom surface of the heater chip 40. While the arrangement of backside ink trenches is illustrated for a certain heater chip 40, the invention can be employed to accommodate heater chips with other arrangements of backside ink trenches.

Attached to the backside ink trench side of the heater chip 40 is a conventional ink manifold 42, only a portion of which is shown. The length of the ink manifold 42 can be somewhat longer, or the same length as than the heater chip 40. In any event, the ink channels on the bottom of the ink manifold 42 are closed channels, although the cross section shown in FIG. 5 is through the ink channel features. There is thus one ink manifold 42 for each heater chip 40. The staggered heater chips 40 and associated manifolds 42 are mounted to a page wide plastic or ceramic base member (not shown). The ceramic base member communicates the supply of the various ink colors from the respective ink supply reservoirs to the ink manifold 42.

The ink manifold 42 includes elongate ink channels that are mirror images of the backside ink trenches 46-54 of the heater chip 40. The manifold ink channel 56 supplies ink to the backside ink trench 46 of the heater chip 40, ink channels 58 and 60 supply respective colored inks to the associated backside ink trenches 48 and 50. A larger-width ink channel 62 of the manifold 42 supplies black ink to both of the backside ink trenches 52 and 54 of the heater chip 40. The ink manifold 42 is constructed with a number of ink ports on the top side thereof, where each ink port is connected internally to a respective ink channel. In particular, the ink port 64 is coupled to channel 56, ink port 66 is coupled to channel 58, ink port 68 is coupled to channel 60 and ink port 70 is coupled to channel 62. The ink ports are illustrated as being square or rectangular, but could be other shapes. As noted above, situated over the ink manifold 42 is a conventional ceramic base member for interfacing the manifold 42 to the different sources of liquid ink.

The length of the heater chip 40 can be about one inch, as measured in the direction of the length of the backside ink trenches, and the width can be between about 0.1-0.9 inches. While the length of the heater chip 40 is somewhat limited in page wide designs, the width can be minimized to reduce the size of the heater chip 40 to thereby minimize the cost. When making the width of the heater chip 40 smaller, the distance between the backside ink trenches 46-54 is generally made smaller also. The ink channels 56-62 of the manifold 42 must be made correspondingly closer together. When the semiconductor wafer of heater chips is direct bonded to the semiconductor wafer of ink manifolds, the distance between the features is not as critical. This is because semiconductor wafers can be fabricated with features that are small and with very accurate dimensions. Another reason is that the direct bonding technique does not require a liquid or other type of adhesive, but rather requires only the nascent surface areas around the features to be molecularly bonded to the corresponding surface areas of the adjacent semiconductor component. Thus, very small seal width surface areas can be utilized between the heater chip 40 and the ink manifold 42. In like manner, the distance between the ink manifold ports is usually made shorter also, but only to the extent that a sufficient seal width surface area is needed for adhesive bonding of the manifold 42 to the adjacent ceramic base member. While the scaling of the size of the various ink carrying features is possible according to current semiconductor processing techniques, a problem can arise that the volume flow rate of ink supplied to the heater chip 40 may be reduced. Thus, the simple scaling of the ink carrying features may be desirable in terms of reducing the size of the printhead components, but the ability to carry the necessary volume flow rate of ink per unit of time may be correspondingly compromised.

A single ink port, such as port 64 of the manifold 42, can supply ink to a heater chip 40, where the chip 40 has, for example, 128 heater chambers and nozzles. In order to prevent the restriction of ink that can be carried by a port 64, the port can be made as large as possible, while yet maintaining an adequate seal width around the port 64 so that it can be reliably registered and bonded to the overlying ceramic base without experiencing misalignment between the components and overlap of the features, which results in reduced seal widths. A seal width between the ink-carrying features, such as between the port 64 and the neighbor ports 66 and 68, is typically between about 100-800 microns according to current processing and alignment techniques. As will be described in detail below, the ink carrying features of the manifold 42 can be arranged so that specified seal widths can be achieved. The ability to arrange the ink-carrying features to maintain a specified seal width allows the features to be made larger and thus handle a higher capacity of ink. It should be noted that the use of a ceramic or plastic base member reduces the cost of the printhead, but such materials cannot be made with tolerances as small as can be achieved with semiconductor wafers.

Figure 6:
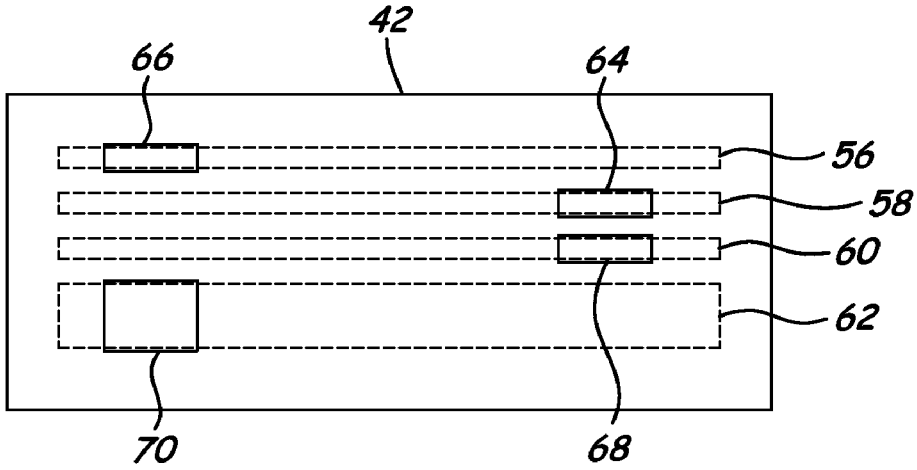
Fig. 6 (PRIOR ART)
FIG. 6 is a top view of another embodiment of an ink manifold constructed according to the invention.

FIG. 6 is a top view of the ink manifold 42 of FIG. 5. The ink manifold 42 is fabricated so that the bottom ports are in fluid communication with the overlying channels. The bottom port 66 feeds a supply of ink to the entire length of the respective ink channel 56. The same is the case with bottom ports 64 and 68 with respect to ink channels 58 and 60. A larger bottom port 70 is effective to feed liquid ink to the large dual ink channel 62. It can be seen that a single ink port must be capable of feeding the volume of ink necessary to supply the corresponding heater chambers and nozzles at peak demand. When the size of the printhead is of less concern, this is not a problem, as the ports and channels need be constructed with sizes and paths that allow the maximum amount of liquid ink to pass therethrough during peak demands. However, and as noted above, when the size of the heater chips are scaled down to reduce manufacturing costs, the passageways of the liquid ink are also made smaller, and thus tend to restrict the volume flow rate of ink, unless other measures are instituted.

In accordance with some embodiments of the invention, disclosed is a technique of scaling the size of the ink manifold to mate with a scaled-down heater chip so that the features are smaller, but the supply of ink through the ink manifold is not compromised, but rather is optimized. Since semiconductor chips are easily scalable when new technologies are available, the features can be made smaller and closer together. Thus, a semiconductor heater chip can be scaled to make it thinner and narrower so that less processing time is involved. When the processing time of a semiconductor wafer can be reduced, then more wafers can be processed in a given period of time, and the costs of production thereof reduced. In like manner, when fabricating a semiconductor ink manifold, it can also be scaled so that the features are made smaller to match the corresponding features of the semiconductor heater chip. Accordingly, the backside ink trench of the heater chip can be made shallower and smaller, and the ink channels of the manifold can be made corresponding smaller, so that when the semiconductor chips are mated and bonded together, the backside ink trenches of the heater chip are aligned with the corresponding ink channels of the manifold. The less critical components of the printhead, such as the base member which is attached to the port side of the semiconductor manifold, can be made of another material, such as ceramic or plastic, which is less costly than the heater and manifold chips. In most instances, the ceramic or plastic components that are attached to the port side of the manifold cannot be fabricated with the precision utilized in fabricating the semiconductor parts. Thus, when bonding the semiconductor manifold to the ceramic or plastic base member, there is yet a problem of maintaining sufficient die bond surface area to assure a reliable bond therebetween. In other words, the surface areas of the printhead components that interface together must remain sufficient to accommodate the application of an adhesive according to the die bond dispensing technology available.

The surface area to which the adhesive is applied around a feature, such as an ink port of the ink manifold, is referred to as a seal width. The seal width is specified for the particular type of adhesive dispensing technology employed. In other words, irrespective of the amount by which the features are scaled to miniaturize the component, if a given die bond technique is specified, then the seal width around the features to be bonded to another component must comply with the specification of the die bond technique being used.

In accordance with a feature of the invention, when the different parameters of the features of the ink manifold are specified, including the seal width, then the number of ports and location thereof on the port side of the manifold can be determined. In this manner, the ink carrying capacity through the ink manifold to the heater chip to which it is attached can be maximized.

Figure 7:
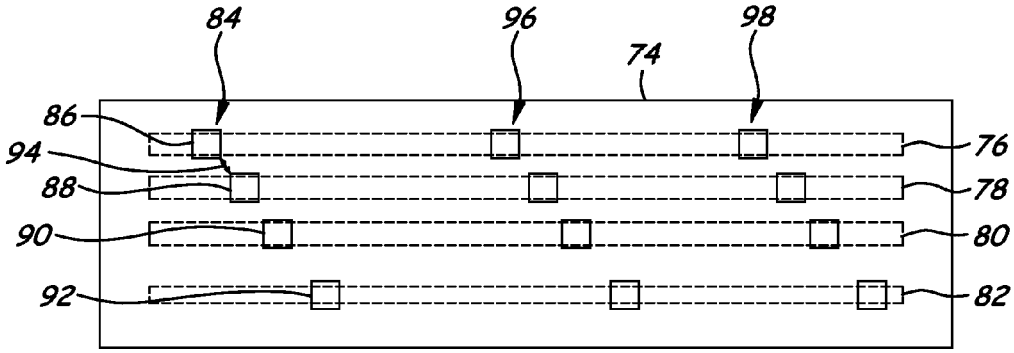
FIG. 7 is a top view of another embodiment of the ink manifold.

FIG. 7 illustrates an optimization of a seal width around the ports of an ink manifold 74 according to one embodiment of the invention. The manifold 74 includes four identically constructed ink channels 76, 78, 80 and 82 formed in the ink manifold. In order to maintain a desired volume flow rate of ink to the four ink channels 76-82, there are plural groups of ink ports. One group 84 includes the ports 86, 88, 90 and 92 that are in liquid communication with the respective ink channels 76-82. However, the ink port 88 of channel 78 is not aligned with the ink port 86 of channel 76. Rather, the ink ports 86 and 88 are located on a diagonal with respect to each other, as are the other ink ports 90 and 92. More specifically, the ink ports 86-92 are all spaced apart along a diagonal or angle. This configuration of ink ports 86-92 allows the corresponding ink channels 76-82 to be spaced close together, but the distance between the ports of the group 84 is greater than the spacing or pitch of the ink channels 76-82. The pitch of the ink channels 76-82 is the center-to-center distance between the adjacent channels 76-82. The seal width between the adjacent ports 86 and 88 is the distance 94 between the closest corners of such ports. Because the seal width 94 between the ports is greater than the pitch between the ink channels 76-82, the manifold 74 can be scaled with the associated heater chip without minimizing the seal width. Thus, the seal width can be chosen according to a predefined die bond technique utilized, even though the features of the manifold 74 have been reduced in size.

In order to maintain a given ink carrying capacity to the manifold 74, additional ink groups can be employed, such as diagonal ink groups 96 and 98. With this configuration, three ink ports serve to carry liquid ink to the ink channel 76. Three other ink ports are effective to carry liquid ink to the other respective ink channels 78, 80 and 82. In the event that the seal width is to be even greater than shown, then the ink ports of a group can be located at a greater angle, than shown. In other words, the ink port 88 would be located further to the right in the drawing than ink port 86, and similarly with ink ports 90 and 92. The other ink ports of the groups 96 and 98 would be similarly located on more of an angle to increase the seal width between neighbor ports of the groups.

Figure 8:
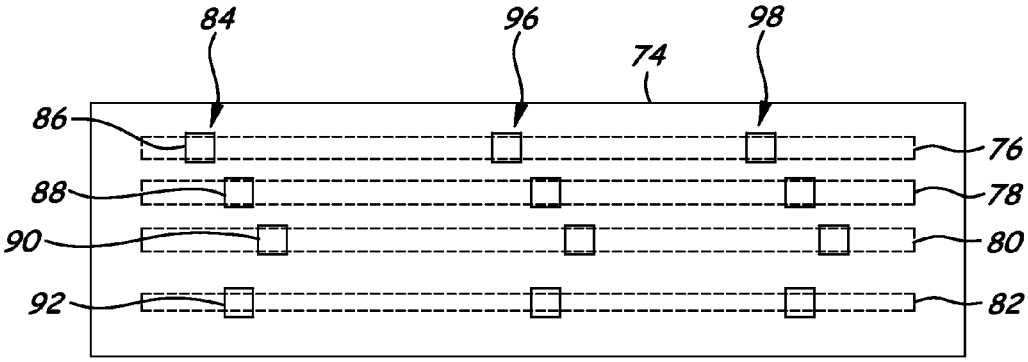
FIG. 8 is a top view of another embodiment of the ink manifold, showing another configuration of ink ports.

With regard to FIG. 8, there is illustrated another arrangement of ink ports fabricated in the ink manifold 74. Here, the ports 86, 88 and 90 of group 84 are arranged in the same manner as that shown in FIG. 7. However, port 92 is not aligned at the same angle as the other ports of the group 84, but rather is vertically aligned with port 88. Although not all ports are aligned together along the same diagonal, the same seal width exists between each port of the group. The group 96 of ports and the group 98 of ports are configured in the same manner as the group 84.

Figure 9:
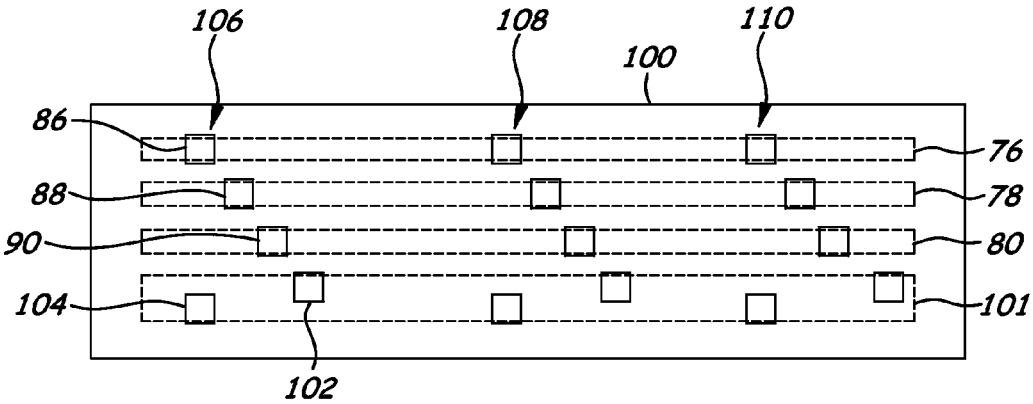
FIG. 9 is a top view of yet another embodiment of the ink manifold, showing yet another configuration of ink ports.

FIG. 9 illustrates yet another arrangement of ports in the manifold 100. In this embodiment of the manifold 100, there are four ink channels formed on the backside thereof, but channel 101 is a dual width channel. The dual width channel 101 is adapted for carrying a high capacity of liquid ink. The ink ports 86, 88 and 90 are situated with respect to the associated ink channels 76, 78 and 80 in the same manner described above. However, there are two ink ports 102 and 104 coupled to the dual width ink channel 101. The ink port 102 is aligned with the other ports 86, 88 and 90 at an angle, but the other port 104 of the dual ports is vertically aligned with the port 86. The port 104 could as well be vertically aligned (in the drawing) with the port 88. The port groups 108 and 110 are similarly situated.

The optimization of the location of the ports of the ink manifold can be determined based on a mathematical model. The model includes many of the parameters of the ink manifold, including the length and width of the ink channels, the length and width of the ink ports, the desired seal width, the dimensions of the heater chip backside ink trenches, and many other considerations. The details of the mathematical model are described below.

Consider a number n of parallel, identically spaced ink channels having the same length, and formed in one planar surface of a manifold chip or slab of material having opposite planar parallel surfaces. Each ink channel is divided into sections of identical length h, and each ink channel section communicates with an upstream ink source through a single port. The ink channels are formed into one planar surface of the manifold chip and the ports are formed into the other planar surface. While the model is described in connection with the efficient formation of an ink manifold, the model can be applied with equal effectiveness to many other printhead components, whether adapted for an inkjet printhead or not.

The channel side of the ink manifold is sealed against a second material layer, such as a heater chip, in which evenly spaced (smaller) individual features supply ink ejectors located along the length of each channel. Similarly, the port side of the ink manifold is sealed to a third material layer containing (larger) upstream channels to supply ink to the ports of the manifold. This second interface is critical to the port and channel layout because of an imposed minimum seal width or breadth between ink ports in the manifold. The seal breadth constraint ensures the satisfaction of the practical requirements of die bond integrity and component alignment.

As a convenience, the ports and channels are described as having rectangular cross sections, although other cross-sectional shapes can be employed. The dimensions of the manifold channels and ports enter into the details of the analysis, as a convenience, and are not essential to the final result. Alternatively, the rectangular shapes can be circumscribed around a more desirable shape of the manifold port.

The dimensions and locations of the manifold features are identified with respect to a rectangular x-y grid. The x-axis lies parallel to the ink channels of the manifold, and the y-axis lies perpendicular the ink channels. The terms 'length' and 'width' respectively describe dimensions parallel and perpendicular to the ink channels. Hence, the width of a port can exceed its length.

The port and channel structure described above is functionally considered as a single material 'layer' sandwiched between adjacent layers with different functions. Whether or not this 'layer' is rendered in physically distinct material layers, it can be decomposed into two or three distinct sub-layers, namely:

1. A channel sub-layer comprised of n parallel rectangular trenches (channels), of length L and width w, with depth equal to the thickness of this first sub-layer. The channels are regularly spaced v width units apart.
2. A port sub-layer comprised of rectangular holes (ports), of length a and width b, with depth equal to the thickness of this second sub-layer. Each port serves a single channel section of length h.
3. An optional sub-layer connecting the above two. It is comprised of rectangular holes (ports) of length a' and width b', with depth equal to the thickness of this third sub-layer. Its distinction from the port sub-layer lies in its potential to isolate adjacent channels in the event that the port width b exceeds the channel spacing v.

The goal is to find a minimum channel section length h consistent with specified dimensions for channel pitch v, channel width w, port length a, port width b and layer-to-layer seal breadth s. The channel section length marks the period of a repeating pattern of n elements, where n equals the number of parallel ink channels.

The desire to find a minimum channel section length h stems from fluid dynamical considerations which relate to the dimensions a, b, a', b' and w, along with the sub-layer thicknesses.

Two attributes that render the solution uniformly valuable are:

Periodicity: so that the port-placement scheme for n channels can be replicated along the x-axis—parallel to the ink channels. The number of replications is determined generally by the length of the heater chip, and more particularly by the length of the backside ink trenches.

Minimum Channel Section Length: so as to allow for a synergistic minimization of the parameters a, b, v and w, while satisfying the primary requirement of delivering an adequate supply of ink.

The index of notations used herein are:

n . . . number of ink channels—equal to the number of ink ports per periodic cluster (serving a single multi-channel section)
a . . . ink port length
b . . . ink port width
u . . . ink port x-pitch
v . . . ink port y-pitch (identical to channel pitch)
L . . . ink channel total length
w . . . ink channel width
s . . . minimum (diagonal) seal breadth between ink ports
k . . . diagonal port count: an integer function of b, v, and s
m . . . cluster k-multiple: an integer function of b, v, s an n
h . . . distance (along x-axis) between periodic n-port clusters; that is, the ink channel section length
i, j . . . port index symbols
x(i) . . . x-coordinate of the center of port i
y(i) . . . y-coordinate of the center of port i
p(i)=[x(i), y(i)] . . . xy location of the center of port i
c(i/j) . . . location of the corner of port i nearest the boundary of port j
d(i, j) . . . Cartesian distance between points c(i/j) and c(j/i).

As a convention, the center of port number 1 is placed at the origin of the xy-plane:

$p(1)=[x(1),y(1)]=(0,0)$.

The n ports in a periodic cluster are indexed (1, 2 . . . n) in order of their increasing y-coordinate. The first port in the succeeding adjacent cluster is given the index n+1. Ports are often indexed in one of two forms:

i . . . where $1 \leqq i \leqq n$,
jm+i . . . where $1 \leqq i < k$, $0 \leqq j \leqq m$, and $km \leqq n$.

Formal Problem Statement:

Suppose a positive integer n and four positive real numbers a, b, v and s are given. The numbers a and b represent the lengths and widths of n identical rectangular ink ports arranged in n rows, with row (channel) pitch v. The number s represents the seal width and is the minimum distance between points on the (rectangular) boundaries of any two ports. The n rectangles taken together represent one of multiple periodic clusters arranged along the x-axis (parallel to the n rows/channels).

The aim is to find a column pitch u and a cluster period h such that h is a minimum. The cluster period h corresponds to the length of a channel section fed by an individual rectangular ink port. The solution is set forth below.

Dimensional Restrictions: Dimensional Domain:

The obvious dimensional restrictions on the structure of the multi-part layer can be summarized as follows:

Two sub-layers: $w<v$, $b<v$,

Three sub-layers: $w<v$, $b'<v$.

If these restrictions are violated, adjacent ink channels in the manifold will be in communication and the different inks will mix. The full range of dimensional possibilities is thus considered. These can be described as follows:

$0<b<v$, $s+b<v$ $0<b<v$, $s+b\geqq v$ $0<b\geqq v$.

Subsequent Port Clusters:

Suppose that the problem has been solved; that is, u and h have been determined for a particular set of parameters: n, a, b, v, s. Then the positions p(i) of port centers have been determined for the first cluster of ports:

$p(i)=[x(i),y(i)]$, $i=1, 2, \ldots, n$.

The positions p(jn+i) of port centers in subsequent clusters can then be specified as follows:

$p(jn+i)=[x(i),y(i)]$, $x(jn+i)=x(i)+jh$, $y(jn+i)=y(i)$, where: $i=1, 2, \ldots, n$, $j=1, 2, 3, \ldots$.

Hence, beyond the position of port n+1, which is specified by determining h, there is no further need to discuss the positions of ports in subsequent clusters.

Simplest Case:

If $b<v$ and $s\leqq v-b$, then $k=1$ (the significance of which will be described below) and:

$u=0$, $h=a+s$.

The port centers of the first cluster can be arranged in a column without regard to the seal breadths:

$p(i)=[x(i), y(i)]$, $x(i)=0$, $y(i)=(i-1)v$, $i=1, 2, 3, \ldots, n$;

with port p(n+1) placed at the location:

$x(n+1)=h$, $y(n+1)=nv$.

Hence, the port centers of a multi-cluster array can be placed on a rectangular grid in the following manner:

$p(i)=[x(i), y(i)]$, $x(i)=(i-1)h$, $y(i)=(i-1)v$, $i=1, 2, 3, \ldots, n, n+1, \ldots$.

First Pythagorean Principle:

If $s>v-b$, then the minimum ink port x-pitch u is given by a Pythagorean relation between the locations of the nearest corners of the first and second rectangular ports.

To clarify this, the following points are made:

$c(1/2)=[\frac{1}{2}a, \frac{1}{2}b]$ . . . corner of port 1 nearest port 2

$c(2/1)=[u-\frac{1}{2}a, v-\frac{1}{2}b]$ . . . corner of port 2 nearest port 1

The distance d(1, 2) between this pair of points is given by:

$d(1, 2)=\|c(2/1)-c(1/2)\|$, $=[(u-a)^2+(v-b)^2]^{1/2}$.

The factor $d(1, 2)=s$ is established to find the final condition:

$(u-a)^2+(v-b)^2=s^2$;

This condition can be solved for u (recall: $s\geqq v-b$):

$u=a+\text{sqrt}\,[s^2-(v-b)^2]$.

The symbol sqrt(x) denotes the standard square root function acting on a non-negative real number x.

Introduction to the Classification Scheme:

In order to continue to a complete solution, two integers k and m are introduced. k lies in the interval $1\leqq k\leqq n+1$ such that:

$(k-1)v\leqq s+b<kv$;

while m lies in the interval $0\leqq m\leqq n/k$ such that:

$mk\leqq n\leqq(m+1)k$.

The integer k is called the diagonal port count because it determines the number of ports (1, 2, . . . , k) to be arranged in a (first) diagonal. It is an integer function of the specified parameters b, v, and s and is given by the formula:

$k=1+\text{int}[(s+b)/v]$.

The function int(x), acting on a real number x, is here and elsewhere defined as the (unique) integer y such that $y\leqq x<y+1$.

The integer m is called the cluster k-multiple because it specifies the number of k-fold diagonal port groups in a cluster of n ports. m is an integer function of the specified parameters b, v, s and n and is given by the formula:

$m=\text{int}[n/k]$.

The utility of introducing the integers k and m lies in the fact that they help segregate various cases based on the quantitative relationships among the specified parameters: n, a, b, v, and s. This will become more apparent below. In any event, it is noted that $k=1$ whenever $s+b<v$.

A Second Simple Case:

If $k=2$ and $b<v$, then $s+b<2v$ and the ports can be arranged along the channels in checkerboard fashion. Hence, port centers can be placed on a rectangular grid in the following manner, with the integer m playing no role:

$k=2$, $u=a+\text{sqrt}\,[s^2-(v-b)^2]$, $h=2u$, $x(i)=0$ i odd, for $i=1, 2, \ldots, n$, $x(i)=u$ i even, for $i=1, 2, \ldots, n$, $y(i)=(i-1)v$ $i=1, 2, \ldots, n$, The n-port pattern repeats along the x-axis from the location of p(n+1) as described above.

Second Pythagorean Principle:

If k lies in the interval $3\leqq k\leqq n$, then channel section length can be reduced, as described below. A positive real number h—the n-port cluster period is determined. The number h satisfies a Pythagorean relation between the locations of the nearest corners of the $k^{th}$ and (n+1) st rectangular ports. To understand this, the following points are made:

$c((n+1)/k)=[h-\frac{1}{2}a, \frac{1}{2}b]$ . . . corner of port n+1 nearest port k $c(k/(n+1))=[(k-1)u+\frac{1}{2}a, (k-1)v-\frac{1}{2}b]$ . . . corner of port k nearest port n+1

The distance d(n+1, k) between this pair of points is given by:

$$d(n+1, k)=\|c((n+1)/k)-c(k/(n+1))\|,$$

$$=\{[h-(k-1)u-a]^2+[(k-1)v-b]^2\}^{1/2}.$$

The factor d(n+1, k)=s is set to find the condition that defines h:

$[h-(k-1)u-a]^2+[(k-1)v-b]^2=s^2$.

Solving the condition for h, it is found that:

$h=(k-1)u+a+\text{sqrt}\{s^2-[(k-1)v-b]^2\}$.

Notice here the necessity of the condition by which the integer k was defined: the formula for h is invalid unless $(k-1)v \leqq s+b$.

In the case where $b \geqq v$, recall that, by definition of k:

$(k-1)v \leqq s+b$.

Then, it is easy to understand that:

$u=s+a$, $h=(k-1)u+a+\text{sqrt}\{s^2-[(k-1)v-b]^2\}$.

Port Positions that Minimize Channel Length:

The positions of ports i in the interval $1 \leqq i \leqq mk$ can be described:

$x(jk+i)=(i-1)u$, $y(jk+i)=(jk+i-1)v$, where: i=1, 2, . . . , k, for each j=0, 1, . . . , m.

The positions of ports i in the interval $mk+1 \leqq i \leqq n$ can be described as follows. Define a length t, corresponding to the length by which the length h of the ink channel section serving the first cluster is able to be shortened:

$$t = ku - h,$$

$$= u - a - sqrt\{s^2 - [(k-1)v - b]^2\},$$

$$= sqrt\{s^2 - (v-b)^2\} - sqrt\{s^2 - [(k-1)v - b]^2\}.$$

Notice that $t \geqq 0$ whenever $k \geqq 3$. If mk<n, then x(mk+1) is chosen to lie in the interval:

$0 \leqq x(mk+1) \leqq t$, with: $y(mk+1)=mk \cdot v$.

Positions of the remaining ports in the first cluster are described as follows:

$x(mk+i)=x(mk+1)+(i-1)u$, $y(mk+i)=(mk+i-1)v$, where: i=1, 2, . . . , n−my.

If $k \geqq n$, then nothing better can be done than to arrange the ports along a single diagonal. Notice that m=0 in this case:

$x(i)=(i-1)u$, i=1, 2, . . . , n, $y(i)=(i-1)v$, i=1, 2, . . . , n, where: $u=a+\text{sqrt}\,[s^2-(v-b)^2]$.

If k=n, then: $h=(k-1)u+a+\text{sqrt}\,\{s^2-[(k-1)v-b]^2\}$.

If k>n, then: h=nu.

The n-port pattern repeats along the x-axis from the location of p(n+1) as described above.

Auxiliary Observations:

Only in the case where k is an integral divisor of n; that is, when mk=n, does the above scheme uniquely determine the locations of all ports. As noted above, if n>mk, the positions of ports i, $mk+1 \leqq i \leqq n$, can be adjusted to the left (along the x-axis), so long as $x(mk+1) \geqq 0$. This freedom in port placement can be used to achieve ancillary goals of the port layout; for example, to create space on the manifold for fiducials or other functional structures.

Finally, recall the two simplest cases, for which k=1 and k=2:

If k=1, then s+b<v and:

$u=s+a$, $h=u$.

As noted above, port centers can therefore be arranged in columns without regard to the seal breadths.

If k=2, then s+b<2v and:

$u=a+\text{sqrt}\,[s^2-(v-b)^2]$, $h=2u$.

Here, port centers can be arranged in a simple checkerboard pattern.

These two patterns, in the order presented, contain the highest degrees of planar symmetry and appear to best utilize manifold area with regard to channel and port placement.

The remaining simple case is that for which k=n+1. This is the worst possible case in terms of minimizing channel section length. It does, however, minimize the number of ink ports:

$u=a+\text{sqrt}\,[s^2-(v-b)^2]$, $h=nu$.

A comprehensive solution of the port and channel problem can now be advanced. Suppose an integer n and four positive real numbers a, b, v and s are given. The integers k and m are first computed:

$k=1+\text{int}[(s+b)/v]$.

$m=\text{int}[n/k]$.

Second, the non-negative real numbers u and h are computed:

b<v, s+b<v:

k=1, m=n, u=0, h=a+s.

$b<v \leqq s+b$:

$k \geqq 2$, $u=a+\text{sqrt}\,[s^2-(v-b)^2]$, $h=a+(k-1)u+\text{sqrt}\,[s^2-((k-1)v-b))^2]$.

$b \geqq v$:

$k \geqq 2$, u=a+s, $h=a+(k-1)u+\text{sqrt}\,[s^2-((k-1)v-b))^2]$.

Third, positions p(i)=[x(i), y(i)] are assigned to the ports in the first cluster (i=1, 2, . . . , n):

$x(jk+i)=(i-1)u$, $y(jk+i)=(jk+i-1)v$, for i=1, 2, . . . , k and j=0, 1, . . . , m.

If mk=n, then the exercise is concluded. If mk<n then the remaining n−mk ports are most simply assigned by continuing the above pattern as follows:

$x(mk+i)=(i-1)u$, $y(mk+i)=(mk+i-1)v$, for i=1, 2, . . . , n−mk.

One is actually free to place port p(mk+1) anywhere in the interval, where t=ku−h (for $k \geqq 2$):

$0 \leqq x(mk+1) \leqq t$, $y(mk+1)=mk \cdot v$.

The formula for t can be made more explicit. Notice that no formula for t applies in the case b<v, s+b<v—because then k=1, m=n and mk=n. In the remaining cases, the parameter t can be computed as follows:

$t=\text{sqrt}\,[s^2-(v-b)^2]-\text{sqrt}\,[s^2-((k-1)v-b))^2]$, for b<v, $s+b \geqq v$, $t=s-\text{sqrt}\,[s^2-((k-1)v-b))^2]$, for $b \geqq v$.

If one chooses to use the freedom described above, then the remaining ports in the first cluster can then be positioned as follows:

$x(mk+i)=x(mk+1)+(i-1)u$, $y(mk+i)=(mk+i-1)v$, where: i=1, 2, . . . , n−mk.

Technical Consideration:

Given values for the parameters a, b, v, s and n, the computations of u and h are easily accomplished using the guide described above. The calculation in spreadsheet terms can be seen as:

$u=\text{if}[s+b<v, 0, \text{if}(b \geqq v, a+s, a+f_1)]$, $h=\text{if}(s+b<v, a+s, a+f_2)$, where:

$f_1$=sqrt [$s^2$−(v−b))$^2$], $f_2$=(k−1)u+sqrt [$s^2$−((k−1)v−b))$^2$].

CONCLUSION

From the foregoing, the solution to the problem posed above is solved. The port placement strategy that minimizes channel section length has been described, while maintaining a prescribed minimum seal width distance. The solution specifies an arrangement of ports in clusters that can be repeated along the length of the manifold (parallel to the ink channels) in a periodic manner. The solution has assumed that port cross-sections are identical rectangles, with prescribed length and width; but it can easily be adjusted to accommodate alternative port cross-sectional shapes.

Various configurations of manifold ports resulting from the foregoing analysis are illustrated in FIGS. 10-19. FIG. 10 illustrates an ink manifold having five ink channels (n=5), five sections per ink channel (h=5) and a diagonal port count of unity (k=1). In the first cluster, and in the remaining clusters of ports, the ports are not aligned on a diagonal. The alphabet "X" indicates the locations of the ports in the primary cluster. The alphabet "Y" indicates the location of the first port in the adjacent cluster. The notation "X . . . X" identifies compatible locations of ports where i>mk.

FIG. 11 illustrates an ink manifold having five ink channels (n=5), five sections per ink channel (h=5) and a diagonal port count of unity (k=2). The first port (to the left) in the top ink channel is located on a diagonal with the first port (to the left) in the second ink channel. The same is the case with the first port of the third ink channel and the first port of the fourth channel. The first port (to the left) of the fifth ink channel is not located on a diagonal with the other ports. This pattern of ports is repeated in the subsequent pairs of sections of the ink channels. The ports of the last section (far right) of each of the ink channels are identical to the location of the ports in the first sections of the ink channels.

FIG. 12 illustrates the optimized location of the ink ports for six ink channels (n=6), where the diagonal port count is two (k=2). Here each port in the first section and second section of adjacent ink channels is located on a diagonal.

FIG. 13 illustrates the optimized location of the ink ports for four ink channels (n=4), where the diagonal port count is five (k=5).

FIG. 14 illustrates the optimized location of the ink ports for four ink channels (n=4), where the diagonal port count is three (k=3). The port of ink channel four (bottom) can be located anywhere along the first section of the ink channel.

FIG. 15 illustrates the optimized location of the ink ports for five ink channels (n=5), where the diagonal port count is three (k=3). The port of ink channel four can be located anywhere along the first section of the ink channel, much like that illustrated in the port configuration of FIG. 14. In addition, the port of the second section of the fifth ink channel can be located anywhere along the second section thereof.

FIG. 16 illustrates the optimized location of the ink ports for six ink channels (n=6), where the diagonal port count is four (k=4).

FIG. 17 illustrates the optimized location of the ink ports for seven ink channels (n=7), where the diagonal port count is four (k=4).

FIG. 18 illustrates the optimized location of the ink ports for eight ink channels (n=8), where the diagonal port count is four (k=4).

FIG. 19 illustrates the optimized location of the ink ports for nine ink channels (n=9), where the diagonal port count is four (k=4).

From the foregoing, the description of the methods and apparatus of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An ink manifold for use with a heater chip in an inkjet printhead, said ink manifold comprising:

said ink manifold having a first planar surface and a second opposite planar surface;

a plurality of ink channels located on said first planar surface of said ink manifold, said ink channels for supplying ink to the heater chip, and each ink channel divided into plural sections where each section is the same length;

a plurality of ink ports located on said second opposite planar surface of said ink manifold, said ink ports in liquid communication with respective said ink channels in said manifold; and a single ink port located in each said section of each said ink channel.

2. The ink manifold of claim 1 wherein each ink port is separated from other ink ports by at least a given seal width.

3. The ink manifold of claim 1 wherein ports associated with different ink channels and different section are aligned with each other on a diagonal.

4. The ink manifold of claim 1 wherein a length of said channel sections define a period of a repeating pattern of n elements, where n equals a number the ink channels.

5. The ink manifold of claim 4 wherein the period of repeating pattern is replicated in a direction parallel to said ink channels.

6. The ink manifold of claim 5 wherein a plurality of ink manifolds are attached to a corresponding number of heater chips to define respective printhead components, and said printhead components are mounted to a base member which spans a width of a print medium passed adjacent said heater chip.

7. The ink manifold of claim 6 wherein the pattern is replicated a number of times as a function of a width of a print medium being printed.

8. The ink manifold of claim 1 further including for each ink channel and a corresponding plurality of sections.

9. The ink manifold of claim 1 wherein said heater chip and said manifold are constructed of a semiconductor material.

10. The ink manifold of claim 9 further including a base member attached to said ink manifold, said base member constructed of a material other than a semiconductor material, and said base member having ink passageways for carrying plural colors of ink from respective ink reservoirs to the ports of said manifold.

11. The ink manifold of claim 1 wherein a distance between boundaries of neighbor ports is a given minimum.

12. The ink manifold of claim 1 wherein said sections of each ink channel defines a grid of columns and rows of sections, and each section row overlies and is aligned with a longitudinal axis of a respective said ink channel.

13. A method of fabricating an ink manifold for use with a heater chip in an inkjet printhead, comprising:

forming plural parallel-located ink channel in one surface of the ink manifold so as to be in liquid communication with respective backside ink trenches of said heater chip when the ink manifold is bonded to the heater chip;

forming plural ink port in an opposite surface of the ink manifold, and forming said ink ports so as to be in liquid communication with respective said ink channels in said ink manifold, each said ink port having a shape in the surface of the ink manifold with a boundary;

arranging the ink ports in the ink manifold so that a plurality of ink ports communicate liquid ink to each said ink channel; and arranging the ink ports in the ink manifold so that a specified minimum seal width exists between the boundaries on neighbor ports.

14. The method of claim 13 further including placing each ink port in a channel section, where a length of each said ink channel is divided into plural sections of equal length.

15. The method of claim 14 further including defining a cluster of ink ports located in said sections that define a pattern, where an identical pattern of ink ports in a cluster are repeated plural times as other clusters in said ink manifold.

16. The method of claim 15 wherein ink ports in each cluster are aligned on respective diagonals.

17. The method of claim 16 further including defining a diagonal port count as k, where $k=1+int[(s+b)/v]$, where s is a minimum diagonal seal breadth between neighbor ink ports, and v is a y-pitch of the ink ports, where y is aligned with an axis orthogonal to a longitudinal axis of the ink channels.

18. The method of claim 17 further including defining a cluster k-multiple as m, where $m=int[n/k]$, where n is the number of ink channels and k is the diagonal port count.

19. The method of claim 14 further including minimizing a length of each section and maintaining a seal width between neighbor ink ports greater than a minimum.

20. The method of claim 14 further including arranging the ports so that port $p(n+1)$ is placed at a location $x(n+1)=h$ and $y(n+1)=nv$, where n equals the number of ink channels, x is a location aligned with a longitudinal axis of the ink channel, y is a location orthogonal to x, h is the length of the sections, and v is a pitch between ink ports in the y direction.

* * * * *